US005579043A

United States Patent [19]

Patry

[11] Patent Number: 5,579,043

[45] Date of Patent: Nov. 26, 1996

[54] OPENABLE THERMAL PRINTER

[75] Inventor: Bernard Patry, Orsay, France

[73] Assignee: Axiohm, Montrouge, France

[21] Appl. No.: 325,441

[22] PCT Filed: Nov. 5, 1993

[86] PCT No.: PCT/FR93/01094

§ 371 Date: Oct. 31, 1994

§ 102(e) Date: Oct. 31, 1994

[87] PCT Pub. No.: WO94/11197

PCT Pub. Date: May 26, 1994

[30] Foreign Application Priority Data

Nov. 6, 1992 [FR] France ..... 92 13390

[51] Int. Cl.[6] ..... B41J 11/70

[52] U.S. Cl. ..... 347/222

[58] Field of Search ..... 346/134, 136, 346/145, 24; 347/218, 222, 215; 358/304; 400/621, 690.4, 691

[56] References Cited

U.S. PATENT DOCUMENTS 4,042,939 8/1977 Lloyd et al. ..... 346/24
4,297,039 10/1981 Lees ..... 400/691
4,663,638 5/1987 Hirose ..... 346/136

FOREIGN PATENT DOCUMENTS 4039513 6/1981 Germany .
2226794 7/1990 United Kingdom .
2250478 6/1992 United Kingdom .

*Primary Examiner*—Benjamin R. Fuller
*Assistant Examiner*—Lynne Anderson
*Attorney, Agent, or Firm*—Salzman & Levy

[57] ABSTRACT

A thermal printer for printing on paper (26), the printer comprising a thermal print head (2) that co-operates with a paper drive roll (15) by bearing thereagainst, in which the print head is carried resiliently by a fixed chassis portion (1) while the drive roll (15) is carried by a moving chassis portion (13) hinged to the fixed chassis (1) and forming a cover giving access to the compartment in the printer for containing the roll (12) of paper, characterized in that, when the cover is closed, the zone of contact between the paper drive roll (15) and the row (4) of heating points of the print head (2) is situated above the diameter (14) of said roll that passes through the hinge between the moving chassis (13) and the fixed chassis (1).

7 Claims, 1 Drawing Sheet

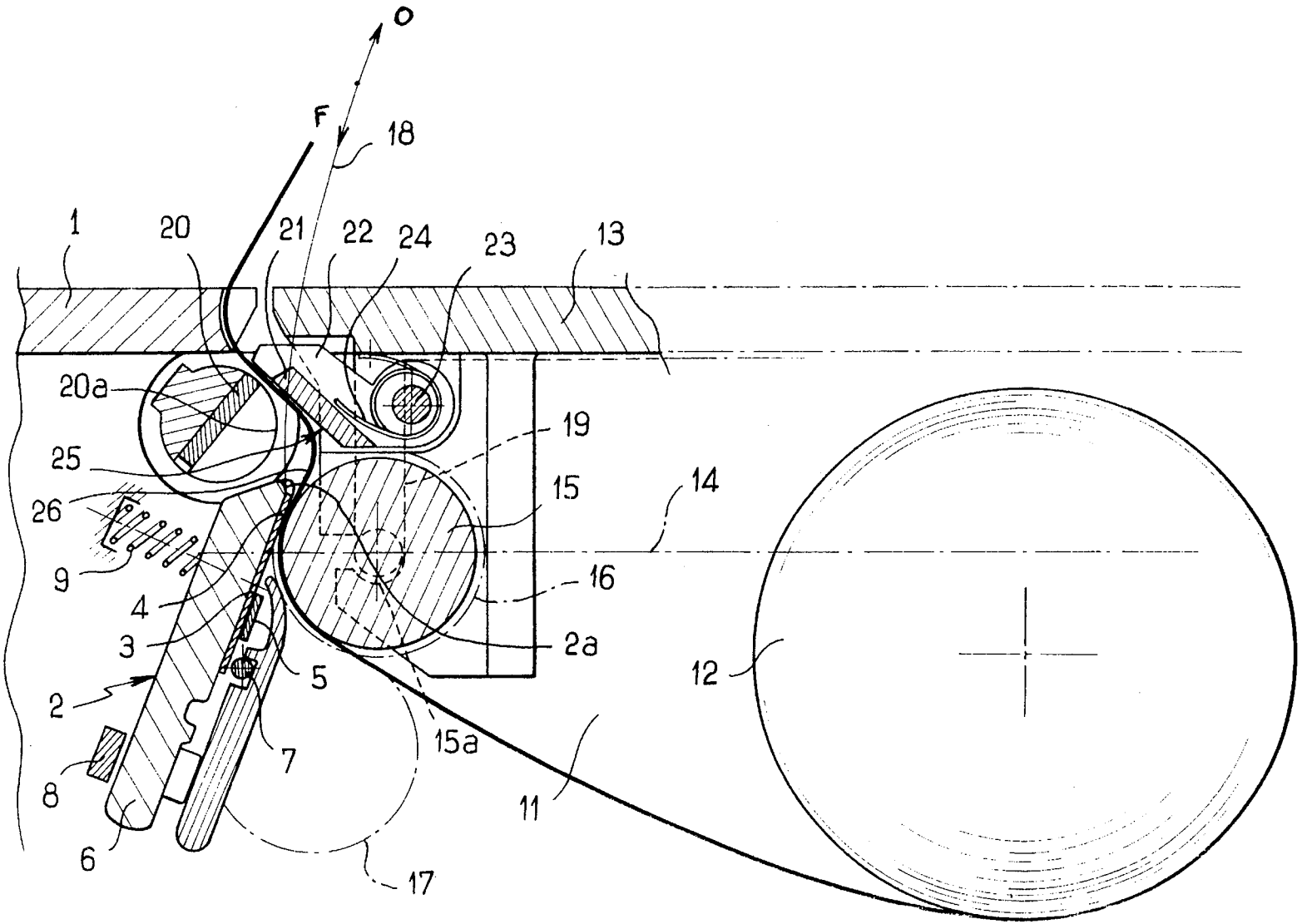
O
F
18
1
13
23
24
22
21
20
20a
25
26
9
19
15
16
14
2a
15a
4
3
5
7
2
8
6
17
11
12

OPENABLE THERMAL PRINTER

The present invention relates to a thermal printer in which inserting and removing the print medium are facilitated.

BACKGROUND OF THE INVENTION

The print medium for thermal printing is generally in the form of a roll of sheet material which is paid out beneath a print head by means of a drive roll (or capstan) and which is then cut into lengths to constitute separate sheets (or receipts, etc.).

One of the main drawbacks of that type of apparatus lies in the difficulty of threading the leading end of a roll through the print head and between the blades of the device for cutting the sheet into lengths.

Printers have already been proposed in which the print medium is installed from the side, i.e. after removing a cover that is perpendicular to the axes of the capstan and of the roll so that the medium can be slotted in parallel to said axes.

Printers also exist in which the print head is separated from the capstan so that they are moved apart from each other parallel to the axis of the capstan. The capstan is then secured to a chassis component that pivots on a fixed component carrying the print head. The pivoting cover moves in relatively complex manner in order to avoid rubbing contact between the capstan and the head when they are being brought together or moved apart. The capstan support therefore begins its separation movement substantially perpendicularly to the head and then moves parallel to the head for disengagement purposes once the capstan is no longer in contact with the head.

The present invention seeks to simplify the structure of thermal printers that are capable of being opened in order to facilitate insertion of the strip of paper; it also has the advantage of being simpler to use than existing printers.

SUMMARY OF THE INVENTION

To this end, the invention therefore provides a thermal printer for printing on a thermal paper type medium, the printer comprising a thermal print head that co-operates with a paper drive roll by bearing thereagainst, in which the print head is carried resiliently by a fixed chassis portion while the drive roll is carried by a moving chassis portion hinged to the fixed chassis and forming a cover giving access to the compartment in the printer for containing the roll of paper. According to one of the characteristics of the invention, when the cover is closed, the zone of contact between the paper drive roll and the row of heating points of the print head is situated behind the diameter of said roll that passes through the hinge between the moving chassis and the fixed chassis, where "behind" is as seen in the closure direction of the cover about its hinge. This disposition makes it possible to ensure enough pressure to hold the paper properly against the capstan, the print head forming a resilient latch on closure of the cover.

The portion of the print head situated in front of the row of heating points is shaped to offer a cam-forming surface for displacing the head against the force of a resilient member when the backing roll goes past in the cover-closing direction. In contrast to what could have been feared, this direct contact (with the strip of paper in between) gives rise to no premature damage or wear of the head or of the capstan, thereby making it possible to avoid installing cam devices external to the capstan and to the print head. The capstan rolls without slipping over said (paper-covered) cam surface and therefore without producing any rubbing between the head and the paper that could be driven by the roll. The absence of any complex cam mechanism means that the total bulk of the device is as small as possible.

In order to obtain maximum benefit from an opening thermal printer, the invention also proposes adding thereto a paper cutter member that is likewise capable of opening. To do this, the fixed chassis carries the rotary blade of the cutting member downstream from the print head in the paper travel direction, with the stationary blade being carried by the cover downstream from the backing roll. The stationary blade is secured to a support that is coupled resiliently to the cover, said support or the blade forming a surface for deflecting the path of the paper on leaving the print head.

Other characteristics and advantages appear from the following description of an embodiment of the invention.

BRIEF DESCRIPTION OF THE DRAWING

Reference is made to the sole accompanying FIGURE which is a section view showing an opening print head of the invention.

DESCRIPTION OF PREFERRED EMBODIMENTS

The FIGURE shows only a portion of the printer of the invention. The housing in which it is contained comprises a fixed Chassis portion 1 which, for example, may belong to the chassis of a machine in which the printer merely constitutes a part, e.g. a cash register. The chassis 1 includes all the means required for fixing the thermal print head 2 which essentially comprises a ceramic substrate 3 carrying a row of heating points 4 and chips 5 for controlling the application of power thereto. The face of the substrate 3 opposite to that carrying the row of points and the electronic components carries a radiator 6 for dissipating heat. The print head is hinged about an axis 7 that is secured to the fixed chassis portion 1, and it is urged about the axis 7 against a fixed stop 8 by means of a spring 9. The above representation of the thermal head is entirely schematic and does not include all of the electrical conductor elements for powering it and for connecting it to the controlling microprocessor.

To the right of the FIGURE, the fixed chassis portion 1 includes a compartment 11 capable of receiving a roll 12 of thermal (i.e. heat-sensitive) paper. This compartment is closed by a cover 13 which, for example, is hinged to the fixed chassis portion 1 about an axis that is substantially parallel to the row of points 4 (and thus perpendicular to the plane in the FIGURE) and situated on the line 14.

The end of the cover 13 remote from its hinge axis to the fixed chassis portion 1 is fitted with a paper drive roll 15 called a "capstan" which extends parallel to the hinge axis of the cover 13. This roll is constrained to rotate with a gear wheel 16 suitable for meshing with a complementary gear wheel 17 carried by the fixed chassis portion 1 and forming the last gear wheel in a driving assembly (not shown) which is controlled in known manner to operate synchronously with printing.

When the cover 13 is opened or closed, the extreme generator line of the paper drive roll 15 describes a circular arc 18 that interferes with the end of the print head 2. On this circular arc, arrows F and O indicate respectively the closing direction and the opening direction of the cover 13 when pivoting about its hinge axis. The tip **2*a* of the head (the tip of the radiator 6) is shaped in such a manner that when the cover is closed, the paper drive roll 15 rolls over the said tip, thereby causing the head to pivot about the axis 7 against the force of the spring 9. This shaped surface may be a surface that is inclined or rounded and its effect is to displace the print head to the left as the paper drive roll 15 goes past during closure of the cover 13. The cover reaches its closed position when the shaft 15***a* of the paper drive roll 15 has reached the bottom of a slot 19 in the fixed chassis portion 1, such that the gear wheel 16 meshes with the gear wheel 17. The row of heating points 4 then lies above the line 14, i.e. above the diameter of the paper drive roll 15 which intersects the hinge axis of the cover 13, in other words behind said line 14 in the closing direction F. As a result, the print head 2 constitutes a kind of latch for holding the cover 13 closed.

The printer of the invention also includes a member for cutting the paper 26 leaving the print head. This cutter member is constituted by a rotary blade 20 co-operating with a stationary blade 21. The rotary blade is carried by the fixed chassis portion 1. above the print head 2. The stationary blade 21 is secured to a support 22 which is hinged at axis 23 to the cover 13. This support is subjected to the force of a spring 24 urging it to rotate about the axis 23 in an counter-clockwise direction towards a stop (not shown) which holds the support 22 in a determined position when the cover 13 is open. Closing the cover brings the support 22 into contact with the support 20*a* for the rotary blade 20 so that the edge of the stationary blade 21 crosses the edge of the rotary blade 20, with this being done under the pressure from the spring 24. The moving blade 20 is rotated by a motor carried by the fixed chassis portion 1. This drive is not shown.

It should be observed that the blades used may be made of a ceramic material, in which case it is important to prevent the two blades striking each other when the cover is closed. For this purpose, provision can be made such that while the cover is being closed the support 22 (which is made of metal) bears against a portion of the support 20*a* for the blade 20 via a portion lying outside the ceramic stationary blade 21 which portion of the support 20*a* lies outside said blade 20 and can be in the form of a cam (an eccentric) so that during closure contact between the supports prevents contact between the blades, but after the rotary blade has been put into rotation, the ceramic blades come into contact with each other in progressive manner.

Finally, it should be observed that in this FIGURE, that when the cover 13 is closed, the stationary blade 21 (or its support) forms a surface 25 for deflecting the path of the paper 26 coming from the paper roll 12 on leaving the printer. This surface 25 is at an obtuse angle with the tangent to the paper drive roll 15 that passes through the row of points, the value of the angle being about 135°. This disposition is advantageous since it curves the paper before it goes through the cutting member, with such curvature imparting a degree of "springiness" to the paper which improves the action of the moving blade 20 during cutting and which tends, after cutting, to keep the paper engaged between the two separated blades.

I claim:

1. A thermal printer for printing on paper, comprising a thermal print head having at least one row of heating points, that cooperates with a paper drive roll by bearing thereagainst, the print head being carried resiliently by a fixed chassis portion, said paper drive roll being carried by a cover having a hinge and being hinged to said fixed chassis and forming an access to a compartment in the printer for containing a roll of paper, wherein, when said cover is closed, a zone of contact between said paper drive roll and said at least one row of heating points is situated, in a closing direction of said cover, behind a diameter line of said paper drive roll that passes through said hinge between said cover and said fixed chassis portion, said print head comprising a tip portion disposed in front of said at least one row of heating points, said tip portion being shaped so as to provide a cam-forming surface for displacing said print head when reacting against a force said paper drive roll traveling past said tip portion in said closing direction.

2. A printer according to claim 1, wherein downstream from the print head (2) in a paper travel direction, the fixed chassis portion (1) carries a rotary blade (20) of a paper cutter member, and a stationary blade (21) of said paper cutter member is carried by the cover (13) downstream from the paper drive roll (15).

3. A printer according to claim 2, wherein the stationary blade (21) is carried by a support (22) that is resiliently coupled to the cover (13) and that presents, upstream from a cutting edge of the stationary blade (21), in the paper travel direction, a surface (25) for deflecting a path of the paper (26), which surface forms an obtuse angle with a tangent to the paper drive roll (15) at the row of heating points (4).

4. A printer according to claim wherein the support (22) of the stationary blade (21) is hinged to the cover (13).

5. A printer for printing on paper, the printer comprising a chassis and a print head that cooperates with a paper drive roll, said print head having a cam-shaped tip for facilitating displacement thereof when said paper drive roll is pressed against said print head; and said chassis comprising a first portion and a second portion which are movable one with respect to the other between a first position in which said print head and said paper drive roll are spaced apart and a second position in which said print head bears against said paper drive roll, and wherein, downstream from said print head, in a paper travel direction, said first portion of said chassis carries a moving blade of a paper cutter member, and said second portion of said chassis carries a stationary blade of said paper cutter member; and a support for carrying said stationary blade, said support being resiliently coupled to said second portion of said chassis and presenting, upstream from a cutting edge, in the paper travel direction, a surface for deflecting a path of the paper.

6. A printer according to claim 5, wherein the support of the stationary blade is hinged to said portion of the chassis.

7. A printer according to claim 5, wherein said moving blade is a rotary blade.

* * * * *